US006324762B1

(12) United States Patent
Huang

(10) Patent No.: US 6,324,762 B1
(45) Date of Patent: Dec. 4, 2001

(54) COMBINABLE SCRIBER KNIFE

(76) Inventor: Yin-Hae Huang, No. 56, Min Sheng Street, Feng-Yuan City 42041 (TW)

( * ) Notice: Subject to any disclaimer, the term of this patent is extended or adjusted under 35 U.S.C. 154(b) by 0 days.

(21) Appl. No.: 09/498,133

(22) Filed: Feb. 3, 2000

(51) Int. Cl.[7] ..... B26B 11/00

(52) U.S. Cl. ..... 30/125; 30/332; 7/118; 7/165

(58) Field of Search ..... 30/2, 125, 329, 30/332, 337, 339; 7/118, 158, 165, 167; 81/177.4, 490

(56) References Cited

U.S. PATENT DOCUMENTS 5,553,340 * 9/1996 Brown, Jr. ..... 7/118
5,581,834 * 12/1996 Collins ..... 7/118
5,581,890 * 12/1996 Schmidt ..... 30/335
5,735,005 * 4/1998 Wang ..... 7/165
5,979,057 * 11/1999 Chao ..... 30/125
6,047,619 * 4/2000 Anderson et al. ..... 7/165

* cited by examiner

*Primary Examiner*—Hwei-Slu Payer

(57) ABSTRACT

A combinable scriber knife includes a handle combined with a main housing and a subordinate housing. The main housing has a slotted lock at a first end engageable with a locking plate at a first end of the subordinate housing, a U-shaped hook pivoted at a second end including a locking knot on inner side engageable with a locking hole in a second end of the subordinate housing, a pair of coupling posts on an inner side engageable with a pair of coupling holes in an inner side of the subordinate housing, a plurality of chambers inside the main housing to receive a plurality of the hexagonal shanks of screwdriver which are engageable within a hexagonal central bore at the second of the main housing and a trapezoid shaped blade inserted into the slotted lock and retained by a knot inside the main housing.

2 Claims, 5 Drawing Sheets

4—4

COMBINABLE SCRIBER KNIFE

BACKGROUND OF THE INVENTION

The present invention relates to cutting apparatus and more particularly to a combinable scriber knife which has a housing combined without screws or rivet so as to be readily assembled or disassembled during the replacement of blade.

Conventional scriber knife includes at least two types. The first type comprises a hollow interior handle into which is a breakable blade slidably received. The blade is composed of a plurality of breakable portions. When the edge of the distal portion becomes blunt, it can be broken off and let the sharp-pointed edge of the second portion to be available. This type of scriber knife is convenient in use. However, if wastes of material. Besides, when all portions of the blade is broken off, it becomes useless. The second type of the scriber knife comprises a combined handle which is fastened by screws or rivet and a stronger single blade fixed into the handle. This blade can cut rigid materials. However, it is difficult to change the blade when it becomes blunt.

SUMMARY OF THE PRESENT INVENTION

The present invention has a main object to provide a combinable scriber knife which has a handle releasibly combined with a main housing and a subordinate housing without using screw or rivet.

Another object of the present invention is to provide a combinable scriber knife which has a retaining slot at a first end of the main housing for securing a retaining plate at a first end of the subordinate housing.

Still another object of the present invention is to provide a combinable scriber knife which has a retaining knot in the first end for retaining a blade.

Further object of the present invention is to provide a combinable scriber knife which has a U-shaped hook pivoted at a second end of the subordinate housing for coupling the subordinate housing to an end of the main housing.

Further object of the present invention is to provide a hexagon cavity at the second end of the main housing enabling the knife to engage with a shank of screwdriver.

Further object of the present invention is to provide a combinable scriber knife which includes a plurality of chambers inside the handle for receiving the shanks of screwdriver with different heads.

The present invention will become more fully understood be reference to the following detailed description thereof when read in conjunction with the attached drawings.

DETAILED DESCRIPTION OF THE PREFERRED EMBODIMENT

Figure 1:
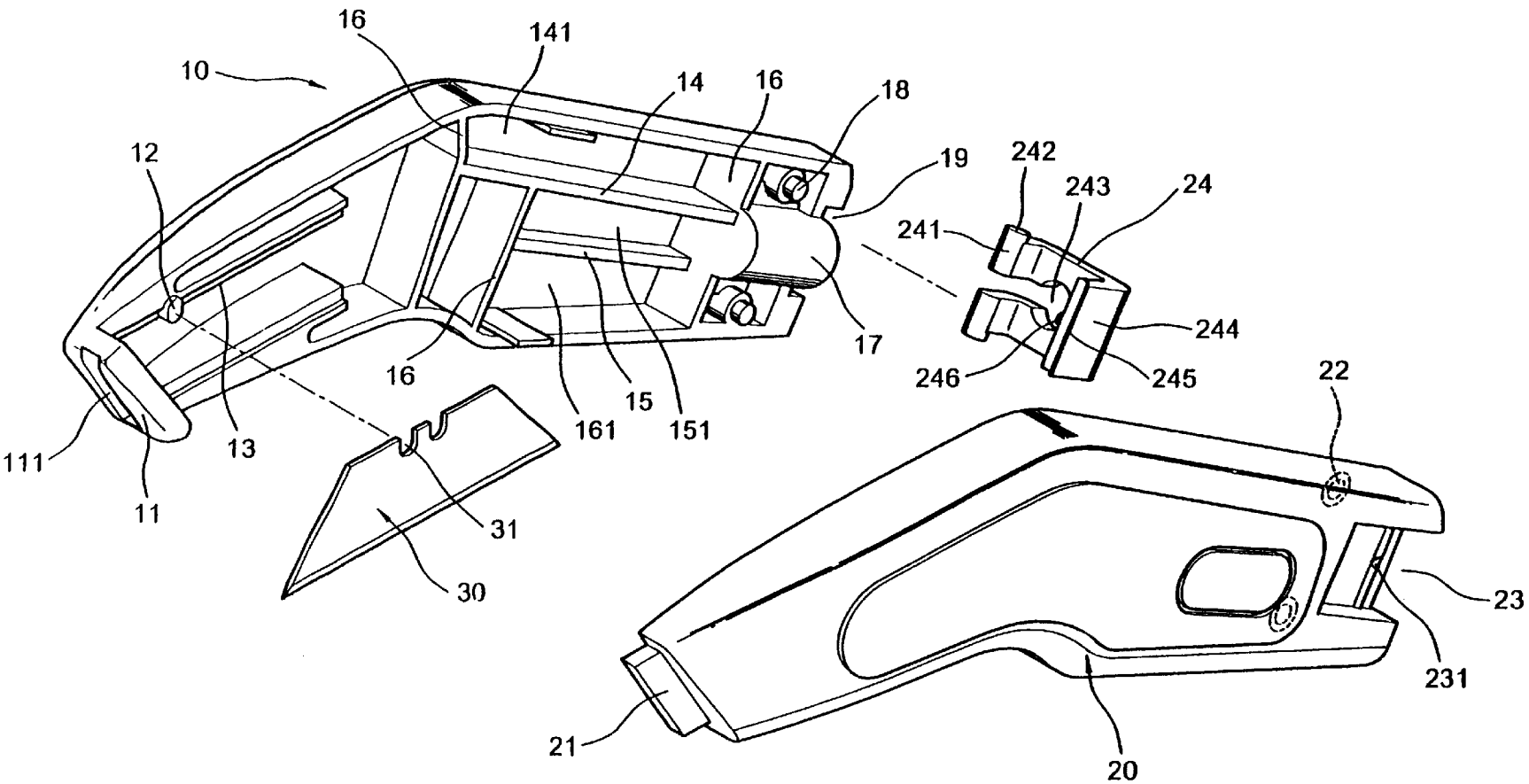
FIG. 1 is an exploded perspective view to show a combinable scriber knife of the preferred embodiment according to the present invention.
Figure 2:
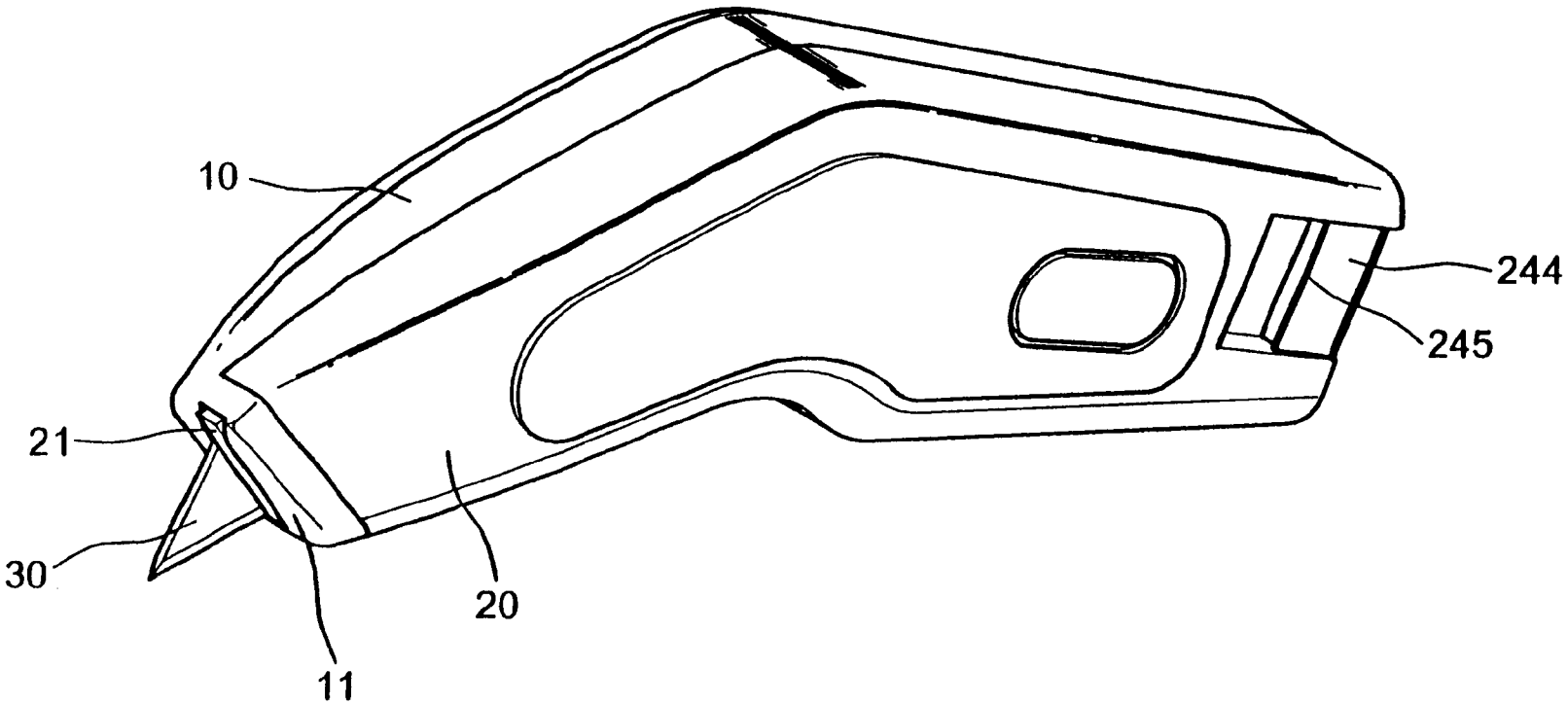
FIG. 2 is a perspective view to show an outlook of an assemblage of FIG. 1.
Figure 3:
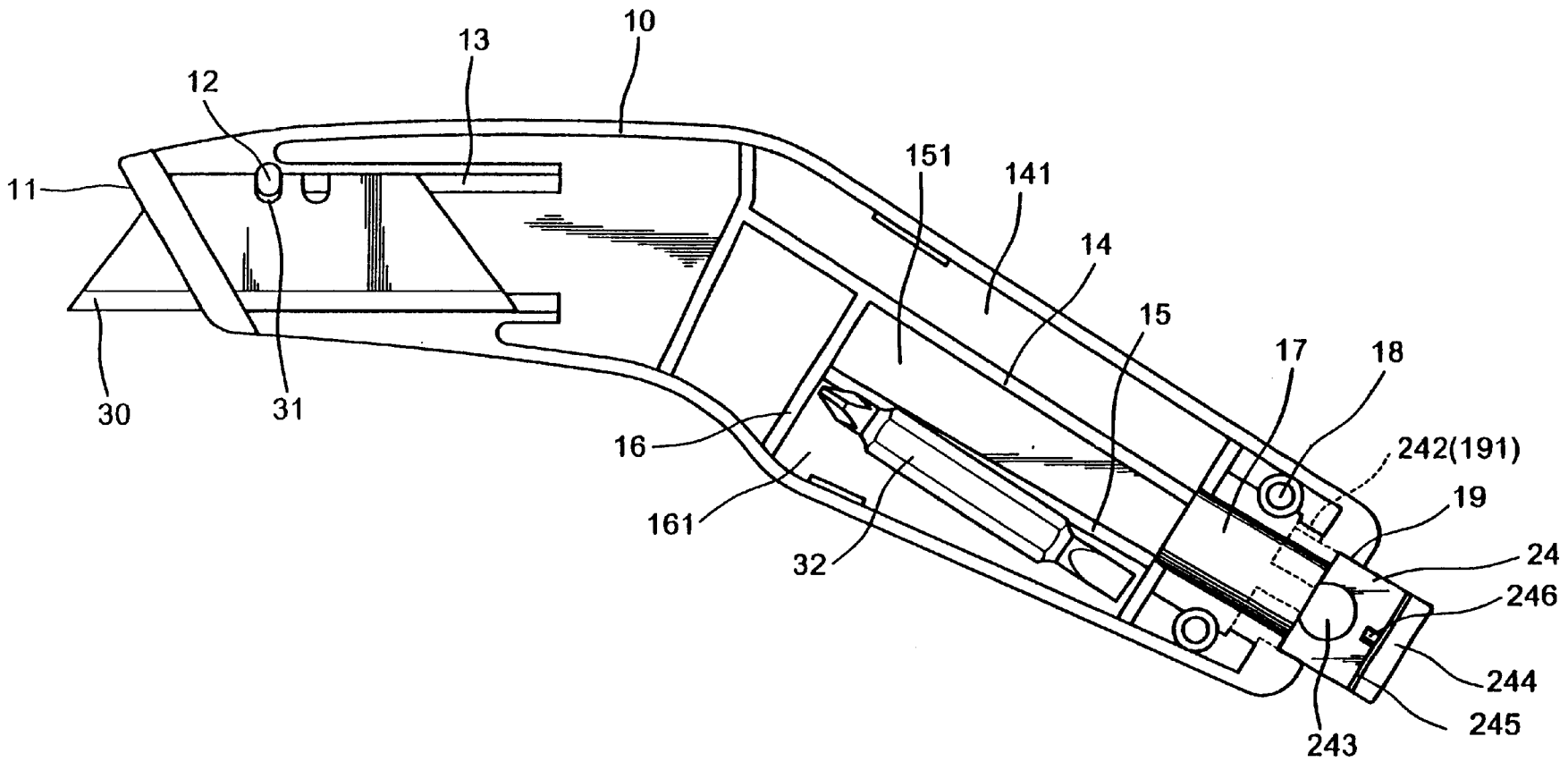
FIG. 3 is a perspective view to show an inner structure of the present invention.

With reference to FIGS. 1, 2 and 3 of the drawings, the combinable scriber knife of the present invention comprises generally a handle releasibly combined with a main housing 10 and a subordinate housing 20 of roughly V-shaped section.

Figure 4:
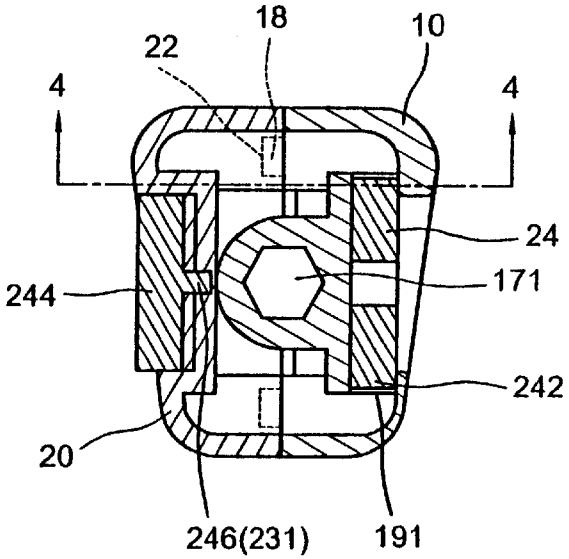
FIG. 4 is a sectional view to show the structure at the second end of the present invention.
Figure 5:
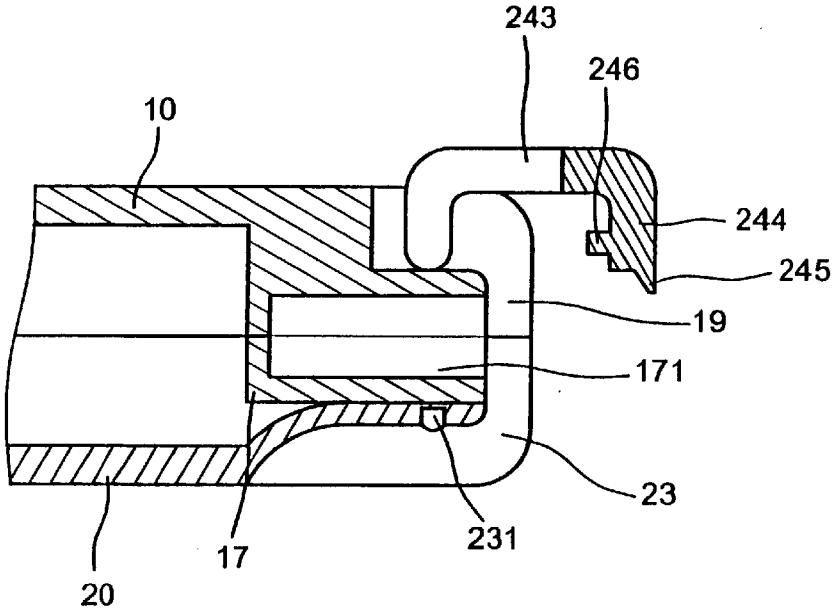
FIG. 5 is a sectional view indicating that the U-shaped hook is at an opening position.
Figure 6:
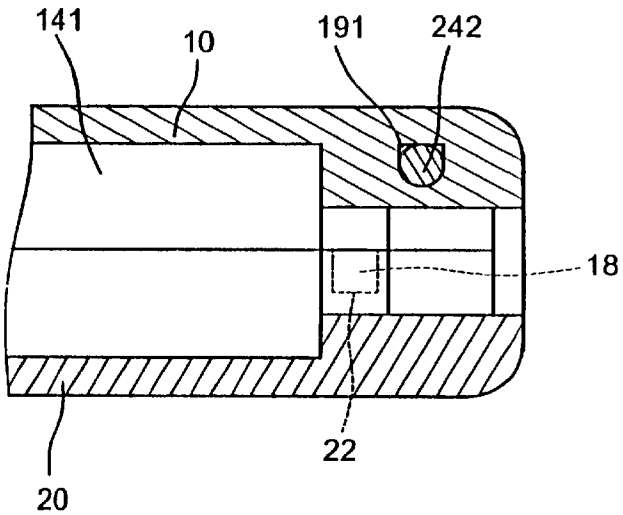
FIG. 6 is a sectional view taken along Line 4—4 of FIG. 4.

The main housing 10 has a lock 11 at a first end including a retaining slot 111, a knot 12 inside the housing 10 adjacent the lock 11, a guide plate 13 abutting the knot 12, a plurality of longitudinal partitions 14 and 15 respectively connected with a plurality of transverse partitions 16 so as to define a plurality of chambers 141, 151 and 161 therebetween, a cylinder 17 centrally formed at a second end including a hexagonal central bore 171 toward outside of the housing 10 (as shown in FIG. 4), a pair coupling posts 18 spacedly formed in the second end aside the cylinder 17, a notch 19 formed in the outer surface of the second end and a pair of pivot holes 191 spacedly formed in the notch 19 adjacent the coupling posts 18. A U-shaped hook 24 has a pair of retaining ends 241 including a pair of elastic extensions 242 at their outer ends pivotally engaged into the pivot holes 191 respectively in a snap fitting, a central hole 243 in a transverse portion of the U-shaped hook 24 engageable with the hexagonal central bore 171 of the cylinder 17, a bevel front edge 245 at a locking end 244 and a locking knot 246 centrally formed on an inner side of the locking end 244 (as shown in FIGS. 5 and 6).

The subordinate housing 20 has a locking plate 21 projected outward form a first end engageable into the retaining slot 111 of the lock 11, a pair of coupling holes 22 spacedly formed in an inner side adjacent a second end engageable with the coupling posts 18, a rectangular depression 23 formed in an outer side abutting the second end and a locking holes 231 centrally formed in the depression 23 engageable with the locking knot 246 of the U-shaped hook 24.

A trapezoid shaped blade 30 engageable into the retaining slot 111 of the main housing 10 and slidable on the guide plate 13 has a pair of retaining notches 31 spacedly formed in the back made engageable with the knot 12.

A plurality of shanks 32 of screwdriver are received in the chambers 141, 151 and 161 of the main housing 10 (as shown in FIG. 3). The shanks 32 each has a hexagonal body engageable with the hexagonal central bore 171 of the cylinder 17, a keystone tip and a phillips tip which may be different in size to fit different size of screws.

When assembling, first engage the blade 30 into the retaining slot 111 of the main housing 10 and engage one of the retaining notches 31 with the knot 12 and dispose the shanks 32 of screwdriver into the chambers 141, 151 and 161 (as shown in FIG. 3), then insert the locking plate 21 of the subordinate housing 20 into the retaining slot 111 from inner side thereof and then combine the main housing 10 and the subordinate housing 20 together when the pair of coupling posts 18 are automatically engaged with the coupling holes 22, finally press the U-shaped hook 24 inward so that the locking knot 246 will be firmly locked in the locking hole 231 in a snap fitting. FIG. 2 shows a well assembled scriber knife of the present invention which is combined without needing a screw or rivet, if inverts the above process to change the blade 30, one can readily disassemble the scriber knife without needing a lock.

Figure 7:
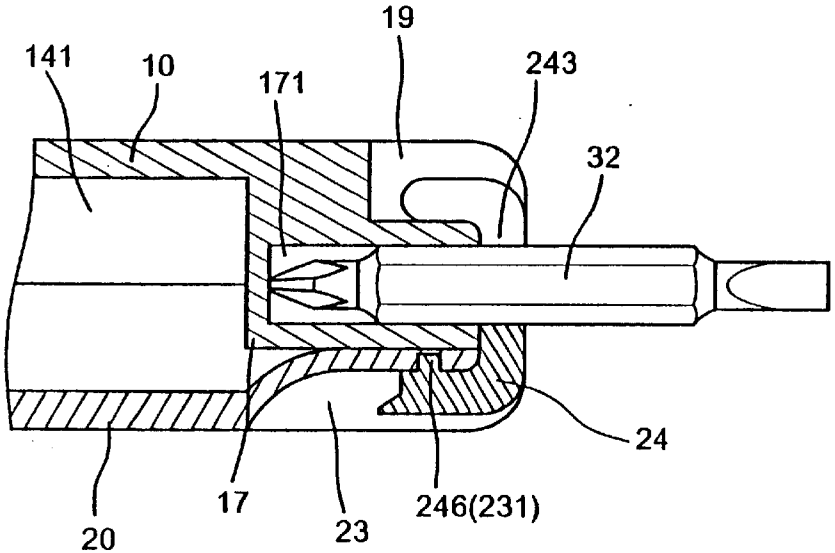
FIG. 7 is a sectional view indicating that a shank of screwdriver engages into the hexagon cavity at the second end of the knife.

When one wants to fasten or unfasten a screw, takes one of suitable shank 32 from the chamber 141, 151 or 161 and engages the shank 32 into the hexagonal central bore 171 (as shown in FIG. 7), it will provide adequate torque to finish the job.

The specification relating to the above embodiment should be construed as exemplary rather as limitative of the present invention with many variations and modifications being readily attainable by a person of average skill in the art without departing from the spirit or scope thereof as defined by the appended claims and their legal equivalents.

I claim:

1. A combinable scriber knife comprising:

a handle of V-shaped section releasibly combined a main housing and a subordinate housing:

said main housing having a lock including a retaining slot at a first end thereof, a knot inside the main housing adjacent the lock, a guide plate abutting the knot, a plurality of longitudinal partitions connected respectively with a plurality of transverse partitions to define a plurality of chambers inside the main housing, a cylinder including a hexagonal central bore toward outward centrally formed in a second end thereof, a pair of coupling posts spacedly formed in the second end aside the cylinder, a notch formed in an outer surface of the second end and a pair of pivot holes spacedly formed in the notch adjacent the coupling posts;

a U-shaped hook having a pair of retaining ends including a pair of elastic extensions extending outward from their outer ends respectively pivoted in the pivot holes of the main housing in a snap fitting, a central hole in a transverse portion of the U-shaped hook engageable with the hexagonal central bore of the cylinder, a bevel edge at a locking end thereof and a locking knot centrally formed on an inner side of the locking end;

said subordinate housing having a locking plate projected outward from a first end thereof engaged with the retaining slot at the first end of the main housing, a pair of coupling holes spacedly formed in an inner side adjacent a second end thereof respectively engaged with the coupling posts of the main housing, a rectangular depression formed in an outer surface abutting the second end of the subordinate housing and a locking hole centrally formed in the rectangular depression engaged with the locking knot of the U-shaped hook;

a trapezoid shaped blade inserting into the retaining slot at the first end of the main housing and slidable on the guide plate having a pair of retaining notches spacedly formed in a back thereof and engaged with the knot of the main housing;

a plurality of shanks of screwdriver disposed into the chambers of the main housing, said shanks each having a hexagonal body engageable with the hexagonal central bore of the main housing, a keystone tip at a first end and a phillips tip at a second end thereof.

2. The scriber knife according to claim 1 wherein said keystone tip and said phillips tip can be different in size.

* * * * *